US006858296B1

(12) United States Patent
Mendelsohn et al.

(10) Patent No.: US 6,858,296 B1
(45) Date of Patent: Feb. 22, 2005

(54) POWER CABLE

(75) Inventors: Alfred Mendelsohn, Brooklyn, NY (US); Kawai Peter Pang, Neshanic, NJ (US); Timothy James Person, Freehold, NJ (US); Jeffrey Morris Cogen, Flemington, NJ (US)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 538 days.

(21) Appl. No.: 09/680,180

(22) Filed: Oct. 5, 2000

(51) Int. Cl.[7] ..... D02G 3/00; H01B 7/00

(52) U.S. Cl. ..... 428/383; 428/372; 428/379; 174/110 PM; 174/113 R; 174/120 SC; 174/120 SR

(58) Field of Search ..... 428/379, 375, 428/383, 372; 252/511; 174/110 PM, 113 R, 23 C, 23 R, 110 SR, 120 SR, 120 SC

(56) References Cited

U.S. PATENT DOCUMENTS

| | | | | |
|---|---|---|---|---|
| 4,286,023 A | | 8/1981 | Ongchin | 428/516 |
| 4,412,938 A | | 11/1983 | Kakizaki et al. | 252/511 |
| 4,493,787 A | | 1/1985 | Taniguchi et al. | 252/511 |
| 5,453,322 A | * | 9/1995 | Keogh et al. | 428/379 |
| 5,719,218 A | | 2/1998 | Sarma | 524/100 |
| 5,766,761 A | * | 6/1998 | Cogen et al. | 428/379 |
| 5,807,635 A | | 9/1998 | Cogen et al. | 428/379 |
| 6,013,202 A | | 1/2000 | Easter et al. | 252/511 |
| 6,232,376 B1 | * | 5/2001 | Tsukada et al. | 524/99 |

FOREIGN PATENT DOCUMENTS

| | | | |
|---|---|---|---|
| EP | 0 420 271 A1 | 4/1991 | H01B/1/24 |
| WO | WO9920690 | 5/1998 | |
| WO | WO9921194 | 10/1998 | |

OTHER PUBLICATIONS

CIBA "CHIMASSORB 2020", product data sheet, Dec. 1998.*

CIBA "CHIMASSORB 944", product data sheet, Dec. 1975.*

* cited by examiner

*Primary Examiner*—Rena Dye
*Assistant Examiner*—J. M. Gray

(57) ABSTRACT

This invention is directed to a cable for electrical conductors which has insulation layer which includes a 2,2,6,6-tetramethylpiperidine and a strippable insulation shield layer which includes a copolymer of acrylonitrile and butadiene.

11 Claims, No Drawings

POWER CABLE

TECHNICAL FIELD

This invention relates to a power cable having semiconducting shields.

BACKGROUND INFORMATION

A typical electric power cable generally comprises one or more electrical conductors in a cable core that is surrounded by several layers of polymeric materials including a first or inner semiconducting shield layer (conductor or strand shield), an insulation layer, a second or outer semiconducting shield layer (insulation shield), a metallic tape or wire shield, and a protective jacket. The outer semiconducting shield can be either bonded to the insulation or strippable, with most applications using strippable shields. The inner semiconducting shield is generally bonded to the insulation layer. Additional layers within this construction such as moisture impervious materials are often incorporated.

Polymeric semiconducting shields have been utilized in multilayered power cable construction for many decades. Generally, they are used to fabricate solid dielectric power cables rated for voltages greater than 1 kiloVolt (kV). These shields are used to provide layers of intermediate conductivity between the high potential conductor and the primary insulation, and between the primary insulation and the ground or neutral potential. The volume resistivity of these semiconducting materials is typically in the range of $10^{-1}$ to $10^{8}$ ohm-cm when measured on a completed power cable construction using the methods described in ICEA S-66-524, section 6.12, or IEC 60502-2 (1997), Annex C. Typical strippable shield compositions contain a polyolefin such as ethylene/vinyl acetate copolymer with a high vinyl acetate content, conductive carbon black, an organic peroxide crosslinking agent, and other conventional additives such as a nitrile rubber, which functions as a strip force reduction aid, processing aids, and antioxidants. These compositions are usually prepared in pellet form. Polyolefin formulations such as these are disclosed in U.S. Pat. No. 4,286,023 and European Patent Application 420 271.

Insulated electrical conductors are typically manufactured by coextrusion by which three layers, the inner semiconducting layer, the crosslinkable polyolefin insulation layer, and the insulation shield are extruded simultaneously, employing coaxial extruders, and subsequently cured in a single operation. This method of manufacture is advantageous in that it results in the close bonding of the three layers, eliminating partial delamination and void formation between layers, caused, during normal use, by flexure and heat. This, in turn, helps prevent premature cable failure. On the other hand, such a method of manufacture for cable constructions requiring a strippable insulation shield presents problems of strippability due to the high bond strength between the crosslinked polyolefin insulation layer and the insulation shield, caused in part by formation of crosslinking bonds across their interface.

While it is important that the insulation shield adhere to the insulation layer, it is also important that the insulation shield can be stripped with relative ease in a short period of time. It is found that the typical insulation shield does not have optimum strippability with respect to the insulation layer. Strippability is very important in that it is not only time saving, but enhances the quality of the splice or terminal connection. It is well understood by those skilled in the art, however, that thermal stability is not to be sacrificed to achieve optimum strippablity.

Three approaches have been taken to achieve acceptable strippability and thermal stability of the insulation shield in combination with commercial insulation layers made up of crosslinked polyethylene; tree retardant, crosslinked polyethylene; or ethylene/propylene copolymer rubbers. The first approach provides an insulation shield made up of an ethylene/vinyl acetate copolymer typically containing 33 percent by weight vinyl acetate and an acrylonitrile/butadiene rubber (NBR). The second uses an ethylene/vinyl acetate copolymer typically containing 40 percent or more by weight vinyl acetate and no NBR. These two approach es provide acceptable strippability, but poor thermal stability. The third approach uses an ethylene/ethyl acrylate copolymer insulation shield. This approach solves the problem of poor thermal stability, but unfortunately exhibits poor or no strippability.

DISCLOSURE OF THE INVENTION

An object of this invention, therefore, is to provide a power cable having an insulation layer surrounded by an insulation shield with improved strippability while maintaining a satisfactory level of thermal stability. Other objects and advantages will become apparent hereinafter.

According to the invention, such a cable has been discovered. The cable comprises an electrical conductor or a core of electrical conductors surrounded by (A) an insulation layer, which is surrounded by, and contiguous with, (B) an insulation shield layer, the (A) insulation layer comprising:

(a) a polymer selected from the group consisting of polyethylene, ethylene/propylene copolymer rubber, ethylene/propylene/diene terpolymer rubber, and mixtures thereof, and, based on the weight of the insulation layer, (b) about 0.005 to about 1 percent by weight of a 4-substituted 2,2,6,6-tetramethylepiperidine containing one or more of the group

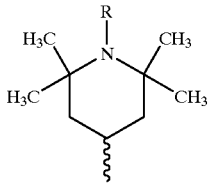

wherein R is hydrogen, or an alkoxy or an alkyl, each having 1 to 50 carbon atoms; and the (B) insulation shield layer comprising:

(a) a copolymer of ethylene and an unsaturated ester selected from the group consisting of vinyl esters, acrylic acid esters, and methacrylic acid esters wherein the vinyl ester is present in the copolymer in an amount of about 10 to about 28 percent by weight based on the weight of the copolymer and the acrylic acid esters and methacrylic acid esters are present in an amount of about 10 to about 50 percent by weight based on the weight of component (B)(a);

(b) a conductive carbon black; and, based on the weight of the insulation shield layer, (c) at least about 5 percent by weight of a copolymer of acrylonitrile and butadiene wherein the acrylonitrile is present in the copolymer in an amount of about 25 to about 55 percent by weight based on the weight of component (B)(c).

DESCRIPTION OF THE PREFERRED EMBODIMENT(S)

The cable described above is generally used in medium and high voltage systems.

The polyethylene used in the insulation can be a homopolymer of ethylene or a copolymer of ethylene and an alpha-olefin. The term "polyethylene" also includes the copolymers of ethylene and an unsaturated ester described below. The polyethylene can have a high, medium, or low density. Thus, the density can range from 0.860 to 0.960 gram per cubic centimeter. The alpha-olefin can have 3 to 12 carbon atoms, and preferably has 3 to 8 carbon atoms. Preferred alpha-olefins can be exemplified by propylene, 1-butene, 1-hexene, 4-methyl-1-pentene, and 1-octene. The melt index can be in the range of about 1 to about 20 grams per 10 minutes, and is preferably in the range of about 2 to about 8 grams per 10 minutes. The ethylene polymers useful in subject invention are preferably produced in the gas phase. They can also be produced in the liquid phase in solutions or slurries by conventional techniques. They can be produced by high pressure or low pressure processes. Low pressure processes are typically run at pressures below 1000 psi whereas, as noted above, high pressure processes are typically run at pressures above 15,000 psi. Generally, the ethylene homopolymer is prepared by a high pressure process and the copolymers by low pressure processes. Typical catalyst systems, which can be used to prepare these polymers are magnesium/titanium based catalyst systems, which can be exemplified by the catalyst system described in U.S. Pat. No. 4,302,565; vanadium based catalyst systems such as those described in U.S. Pat. Nos. 4,508,842 and 5,332,793; 5,342,907; and 5,410,003; a chromium based catalyst system such as that described in U.S. Pat. No. 4,101,445; a metallocene catalyst system such as that described in U.S. Pat. Nos. 4,937,299 and 5,317,036; or other transition metal catalyst systems. Many of these catalyst systems are often referred to as Ziegler-Natta or Phillips catalyst systems. Catalyst systems, which use chromium or molybdenum oxides on silica-alumina supports, are also useful. Typical processes for preparing the polymers are also described in the aforementioned patents. Typical in situ polymer blends and processes and catalyst systems for providing same are described in U.S. Pat. Nos. 5,371,145 and 5,405,901. A conventional high pressure process is described in Introduction to Polymer Chemistry, Stille, Wiley and Sons, New York, 1962, pages 149 to 151. A typical catalyst for high pressure processes is an organic peroxide. The processes can be carried out in a tubular reactor or a stirred autoclave.

Examples of the polyethylene are the homopolymer of ethylene (HP-LDPE), linear low density polyethylene (LLDPE), and very low density polyethylene (VLDPE). Medium and high density polyethylenes can also be used. The homopolymer of ethylene is generally made by a conventional high pressure process. It preferably has a density in the range of 0.910 to 0.930 gram per cubic centimeter. The homopolymer can also have a melt index in the range of about 1 to about 5 grams per 10 minutes, and preferably has a melt index in the range of about 0.75 to about 3 grams per 10 minutes. The LLDPE can have a density in the range of 0.916 to 0.925 gram per cubic centimeter. The melt index can be in the range of about 1 to about 20 grams per 10 minutes, and is preferably in the range of about 3 to about 8 grams per 10 minutes. The density of the VLDPE, which is also linear, can be in the range of 0.860 to 0.915 gram per cubic centimeter. The melt index of the VLDPE can be in the range of about 0.1 to about 20 grams per 10 minutes and is preferably in the range of about 0.3 to about 5 grams per 10 minutes. The portion of the LLDPE and the VLDPE attributed to the comonomer(s), other than ethylene, can be in the range of about 1 to about 49 percent by weight based on the weight of the copolymer and is preferably in the range of about 15 to about 40 percent by weight. A third comonomer can be included, e.g., another alpha-olefin or a diene such as ethylidene norbornene, butadiene, 1,4-hexadiene, or a dicyclopentadiene. The third comonomer can be present in an amount of about 1 to 15 percent by weight based on the weight of the copolymer and is preferably present in an amount of about 1 to about 10 percent by weight. It is preferred that the copolymers contain two or three comonomers inclusive of ethylene.

In addition to the polyethylene described above, another preferred resin for use in the insulation is an EPR (ethylene/propylene rubber), which includes both the ethylene/propylene copolymer (EPM) and an ethylene/propylene/diene terpolymer (EPDM). These rubbers have a density in the range of 1.25 to 1.45 grams per cubic centimeter and a Mooney viscosity (ML 1+4) at 125 degrees C. in the range of about 10 to about 40. The propylene is present in the copolymer or terpolymer in an amount of about 20 to about 50 percent by weight, and the diene is present in an amount of 0 to about 12 percent by weight. Examples of dienes used in the terpolymer are hexadiene, dicyclopentadiene, and ethylidene norbornene. Mixtures of polyethylene and EPR are contemplated.

The insulation also contains about 0.005 to about 1 percent by weight, and preferably about 0.1 to about 0.3 percent by weight, of a 4-substituted 2,2,6,6-tetramethylepiperidine containing one or more of the group

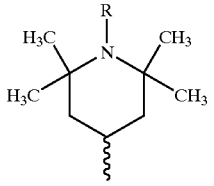

wherein R is hydrogen, or an alkoxy or an alkyl, each having 1 to 50 carbon atoms, and preferably 1 to 18 carbon atoms. Examples of the alkoxy group are methoxy and ethoxy. Examples of the alkyl group are methyl and ethyl.

The resins most commonly used in semiconducting shields are elastomers of varying degrees of crystallinity from amorphous through low and medium crystallinity, preferably copolymers of ethylene and unsaturated esters. Insofar as the insulation shield of this invention is concerned, the unsaturated ester is a vinyl ester, an acrylic acid ester, or a methacrylic acid ester. The ethylene/vinyl ester copolymer has an ester content of about 10 to about 28 percent by weight based on the weight of the copolymer, and preferably has an ester content of about 15 to about 28 percent by weight. The ethylene/acrylic or methacrylic acid copolymer has an ester content of about 10 to about 50 percent by weight, and preferably has an ester content of about 20 to about 40 percent by weight based on the weight of the copolymer. The ethylene/unsaturated ester copolymers are usually made by conventional high pressure processes. These high pressure processes are typically run at pressures above 15,000 psi (pounds per square inch). The copolymers can have a density in the range of 0.900 to 0.990 gram per cubic centimeter, and preferably have a density in the range of 0.920 to 0.970 gram per cubic centimeter. The copolymers can also have a melt index in the range of about 10 to about 100 grams per 10 minutes, and preferably have a melt index in the range of about 20 to about 50 grams per 10 minutes. Melt index is determined under ASTM D-1238, Condition E. It is measured at 190° C. and 2.16 kilograms.

The ester can have about 4 to about 20 carbon atoms, and preferably has about 4 to about 7 carbon atoms. Examples of vinyl esters are vinyl acetate, vinyl butyrate, vinyl pivalate, vinyl neononanoate, vinyl neodecanoate, and vinyl 2-ethylhexanoate. Vinyl acetate is preferred. Examples of acrylic and methacrylic acid esters are lauryl methacrylate; myristyl methacrylate; palmityl methacrylate; stearyl methacrylate; 3-methacryloxypropyltrimethoxysilane; 3-methacryloxypropyltriethoxysilane; cyclohexyl methacrylate; n-hexylmethacrylate; isodecyl methacrylate; 2-methoxyethyl methacrylate; tetrahydrofurfuryl methacrylate; octyl methacrylate; 2-phenoxyethyl methacrylate; isobornyl methacrylate; isooctylmethacrylate; octyl methacrylate; isooctyl methacrylate; oleyl methacrylate; ethyl acrylate; methyl acrylate; t-butyl acrylate; n-butyl acrylate; and 2-ethylhexyl acrylate. Methyl acrylate, ethyl acrylate, and n- or t-butyl acrylate are preferred. In the case of alkyl acrylates and methacrylates, the alkyl group can have about 1 to about 8 carbon atoms, and preferably has about 1 to about 4 carbon atoms. The alkyl group can be substituted with an oxyalkyltrialkoxysilane, for example, or other various groups.

In order to provide a semiconducting shield it is necessary to incorporate conductive particles into the composition. These conductive particles are generally provided by particulate carbon black, which is referred to above. Useful carbon blacks can have a surface area of about 20 to about 1000 square meters per gram. The surface area is determined under ASTM D 4820-93a (Multipoint B.E.T. Nitrogen Adsorption). The carbon black can be used in the semiconducting shield composition in an amount of about 15 to about 45 percent by weight based on the weight of the insulation shield layer, and is preferably used in an amount of about 30 to about 40 percent by weight. Both standard conductivity and high conductivity carbon blacks can be used with standard conductivity blacks being preferred. Examples of conductive carbon blacks are the grades described by ASTM N550, N472, N351, N110, and acetylene black.

Component (B)(c) is a copolymer of acrylonitrile and butadiene wherein the acrylonitrile is present in the copolymer in an amount of about 25 to about 55 percent by weight based on the weight of the copolymer, and is preferably present in the copolymer in an amount of about 30 to about 35 percent by weight. This copolymer is also known as a nitrile rubber or an acrylonitrile/butadiene copolymer rubber. The density can be, for example, 0.98 gram per cubic centimeter and the Mooney Viscosity measured at 100 degrees C. can be (ML 1+4) about 50.

The components can be present in about the following percentages by weight:

| Component | Broad Range | Preferred Range |
|---|---|---|
| Insulation layer | | |
| (A)(a) | 90 to 99 | 96 to 99 |
| (A)(b) | 0.005 to 1 | 0.1 to 0.3 |
| Insulation shield layer | | |
| (B)(a) | 30 to 70 | 40 to 60 |
| (B)(b) | 15 to 45 | 30 to 40 |
| (B)(c) | at least 5 | 10 to 50<br>10 to 30<br>(most preferred) |

The polymers used in the invention are preferably crosslinked. This is accomplished in a conventional manner with an organic peroxide or by irradiation, the former being preferred. The amount of organic peroxide used can be in the range of about 0.2 to about 5 percent by weight of organic peroxide based on the weight of the layer in which it is included, and is preferably in the range of about 0.4 to about 2 parts by weight. Organic peroxide crosslinking temperatures, as defined by a one minute half-life for the peroxide decomposition, can be in the range of about 150 to about 250 degrees C. and are preferably in the range of about 170 to about 210 degrees C.

Examples of organic peroxides useful in crosslinking are dicumyl peroxide; lauroyl peroxide; benzoyl peroxide; tertiary butyl perbenzoate; di(tertiary-butyl) peroxide; cumene hydroperoxide; 2,5-dimethyl-2,5-di(t-butyl-peroxy)hexyne-3; 2,5-dimethyl-2,5-di(t-butylperoxy)hexane; tertiary butyl hydroperoxide; isopropyl percarbonate; and alpha,alpha'-bis (tertiary-butylperoxy)diisopropylbenzene.

Conventional additives, which can be introduced into the composition, are exemplified by antioxidants, coupling agents, ultraviolet absorbers or stabilizers, antistatic agents, pigments, dyes, nucleating agents, reinforcing fillers or polymer additives, slip agents, plasticizers, processing aids, lubricants, viscosity control agents, tackifiers, anti-blocking agents, surfactants, extender oils, metal deactivators, voltage stabilizers, flame retardant fillers and additives, crosslinking agents, boosters, and catalysts, and smoke suppressants. Additives and fillers can be added in amounts ranging from less than about 0.1 to more than about 50 percent by weight based on the weight of the layer in which it is included.

Examples of antioxidants are: hindered phenols such as tetrakis[methylene(3,5-di-tert-butyl-4-hydroxyhydrocinnamate)]methane, bis[(beta-(3,5-ditert-butyl-4-hydroxybenzyl)-methylcarboxyethyl)]sulphide, 4,4'-thiobis (2-methyl-6-tert-butylphenol), 4,4'-thiobis(2-tert-butyl-5-methylphenol), 2,2'-thiobis(4-methyl-6-tert-butylphenol), and thiodiethylene bis(3,5-di-tert-butyl-4-hydroxy) hydrocinnamate; phosphites and phosphonites such as tris (2,4-di-tert-butylphenyl)phosphite and di-tert-butylphenylphosphonite; thio compounds such as dilaurylthiodipropionate, dimyristylthiodipropionate, and distearylthiodipropionate; various siloxanes; and various amines such as polymerized 2,2,4-trimethyl-1,2-dihydroquinoline, 4,4'-bis(alpha,alpha-demthylbenzyl) diphenylamine, and alkylated diphenylamines. Antioxidants can be used in amounts of about 0.1 to about 5 percent by weight based on the weight of the layer in which it is included.

Compounding can be effected in a conventional melt/mixer or in a conventional extruder, and these terms are used in this specification interchangeably. Generally, the conductive shield composition is prepared in a melt/mixer and then pelletized using a pelletizer attachment or an extruder adapted for pelletizing. Both the melt/mixer, as the name implies, and the extruder, in effect, have melting and mixing zones although the various sections of each are known to those skilled in the art by different names. The semiconducting shield composition can be prepared in various types of melt/mixers and extruders such as a Brabender™ mixer, Banbury™ mixer, a roll mill, a BuSS™ co-kneader, a biaxial screw kneading extruder, and single or twin screw extruders. A description of a conventional extruder can be found in U.S. Pat. No. 4,857,600. In addition to melt/mixing, the extruder can coat a wire or a core of wires. An example of co-extrusion and an extruder therefor can be found in U.S. Pat. No. 5,575,965. A typical extruder has a hopper at its upstream end and a die at its downstream end. The hopper feeds into a barrel, which contains a screw. At the downstream end, between the end of the screw and the die, is a screen pack and a breaker plate. The screw portion of the extruder is considered to be divided up into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of about 15:1 to about 30:1. In wire coating, where the material is crosslinked after extrusion, the die of the crosshead feeds directly into a heating zone in which temperatures can be in the range of about 130° C. to about 260° C.

The advantages of the invention are an insulation shield easily strippable from the insulation; improved pellet handling characteristics; a reduction in CV (continuous vulcanization) line decomposition products; higher throughput rates; and cost reduction.

The term "surrounded" as it applies to a substrate being surrounded by an insulating composition, jacketing material, or other cable layer is considered to include extruding around the substrate; coating the substrate; or wrapping around the substrate as is well known by those skilled in the art. The substrate can include, for example, a core including a conductor or a bundle of conductors, or various underlying cable layers as noted above.

All molecular weights mentioned in this specification are weight average molecular weights unless otherwise designated.

The patents mentioned in this specification are incorporated by reference herein.

The invention is illustrated by the following examples.

EXAMPLES 1 TO 10

Examples 1 and 2 demonstrate the effect of including a TMP in tree resistant, crosslinked insulation having an ethylene/ethyl acrylate copolymer insulation shield over the insulation. In this case, the ethyl acrylate content is 35 percent by weight of the polymer. Without a TMP in the insulation (example 1), the insulation shield is fully bonded to the insulation, and cannot be stripped. With a TMP (example 2), the strip force is 10 pounds per 0.5 inch, which is within the typical range for commercial cables.

Strip force is reported in pounds per 0.5 inch. It is measured as follows:

Single plaques are prepared from insulation shield formulation pellets and insulation layer formulation pellets by compression molding. Prior to compression molding, the pellets are melted on a two roll-mill. An organic peroxide is added if crosslinking is desired. The temperature for compression molding of shield pellets is 110 degrees C. Approximately 65 grams of shield formulation are used to prepare a 30 mil plaque. The temperature for compression molding of insulation pellets is 130 degrees C. Approximately 135 grams of insulation formulation are used to prepare a 125 mil plaque. The weighed material is sandwiched between two Mylar™ plastic sheets and is separated from the press platens by sheets of aluminum foil. The following typical pressures and time cycles are used for the compression molding: a) 2000 psi (pounds per square inch) for 5 minutes; b) 50,000 psi for 3 minutes; then c) quench cooling pressure of 50,000 pounds for 10 minutes.

An adhesion plaque sandwich is then made by curing two single plaques under pressure (one shield plaque and one insulation plaque). The Mylar™ sheets are removed from the single plaques and any excess is trimmed. The 125 mil trimmed insulation plaque is placed in a 75 mil mold. At least 2 inches on the top edge of the insulation plaque is covered with a strip of Mylar™ sheet to prevent adhesion to the shield plaque in a region that will form a "pull-tab." The 30 mil shield plaque is then placed on top of the insulation plaque. The sandwich is separated from the press platens by Mylar™ sheets, and placed in the press. The press is then closed and a pressure of 1000 psi is maintained for 4 minutes at 130 degrees C. Then steam is introduced into the press at 190 degrees C. (about 180 psig). A cure cycle of 20,000 psi for 25 minutes (including the time to heat up from 130 degrees C. to 190 degrees C.) is then effected followed by a quench cooling cycle of 20,000 psi for 15 minutes.

The sandwich is removed from the press, the Mylar™ sheets are removed, the excess is trimmed, and the sandwich is cut into five samples (each 1.5 inches wide by about 6 inches long). These samples are placed in a climate controlled room at 23 degrees C. and 50 percent relative humidity overnight before any further testing.

A one half inch strip is marked in the center of each sample. A razor is used to cut along each line so that the black material is cut all the way through to the insulation plaque. A stripping test is achieved with the use of a rotating wheel and an Instron™ or similar tensile apparatus. Each sample is mounted to the wheel with the center strip mounted in the jaws of the tensile machine in such a manner that the tensile machine will pull the center strip from the sandwich plaque and the wheel will rotate to maintain the perpendicular configuration of the surface of the plaque to the direction of tensile force. The jaws of the tensile machine shall travel at a linear speed of 20 inches per minute during the test, and should be stopped when about one half inch of unpeeled material remains. The Maximum Load and Minimum Load are to be reported from the test, while disregarding the first and last inch stripped. The plaque strip force is equal to the Maximum Load.

Examples 3 and 4 demonstrate the effect of including a TMP in tree resistant, crosslinked insulation having an ethylene/vinyl acetate copolymer insulation shield over the insulation. In this case, the vinyl acetate content is 28 percent by weight of the polymer. Without a TMP in the insulation (example 3), the strip force is 13 pounds per 0.5 inch. With a TMP (example 4), the strip force is 8 pounds per 0.5 inch, a 38 percent reduction in strip force.

Examples 5 through 10 demonstrate the effect of including a TMP in tree resistant, crosslinked insulation having an ethylene/vinyl acetate copolymer insulation shield over the insulation. In this case, the vinyl acetate content is 32 percent by weight of the polymer. The insulation shield also contains various levels of NBR. With no NBR, the reduction in strip force with a TMP containing insulation (example 6) relative to a similar insulation without a TMP (example 5) is insignificant (10 pounds per 0.5 inch versus 11 pounds per 0.5 inch, i.e., a 9 percent reduction). With 5 percent by weight NBR, the reduction with a TMP containing insulation (example 8) relative to a similar insulation without a TMP (example 7) is a significant 36 percent. With 10 percent by weight NBR, the reduction with a TMP containing insulation (example 10) relative to a similar insulation without a TMP (example 9) is a significant 71 percent.

Examples 11 through 13 demonstrate the effectiveness of the presence of the TMP in tree resistant, crosslinked insulation having a semiconducting ethylene/vinyl acetate copolymer insulation shield over the insulation. It is noted that the insulation shield remains strippable for insulation shield formulations based upon copolymers of vinyl acetate content lower than that which could be utilized with insulation formulations without the TMP. In this case, the vinyl acetate content is approximately 20 percent by weight. The insulation shield formulation containing 20 percent by weight nitrile rubber is fully bonded to the insulation without TMP, yet strips with a force of between 11 and 12 pounds per one half inch when a small amount of TMP is added to the insulation.

Formulations are prepared and tested as described in U.S. Pat. No. 4,493,787.

Variables and strip force results are set forth in the following Table I.

TABLE I (percent by weight)

| Example | 1 | 2 | 3 | 4 | 5 |
|---|---|---|---|---|---|
| Insulation shield | | | | | |
| EEA | 49.10 | 49.10 | — | — | — |
| EVA 1 | — | — | 47.50 | 47.50 | — |
| EVA 2 | — | — | — | — | 62.40 |
| NBR | 15.00 | 15.00 | 15.00 | 15.00 | — |
| Carbon black | 32.00 | 32.00 | 35.00 | 35.00 | 34.00 |
| Additive 1 | 0.80 | 0.80 | 0.80 | 0.80 | 0.80 |
| Additive 2 | 2.00 | 2.00 | — | — | 2.00 |
| Additive 3 | — | — | 1.00 | 1.00 | — |
| Peroxide 1 | 1.1 | 1.1 | 0.70 | 0.70 | 0.80 |
| Insulation | | | | | |
| LDPE | 97.12 | 96.87 | 97.12 | 96.87 | 97.12 |
| Additive 4 | 0.38 | 0.38 | 0.38 | 0.38 | 0.38 |
| Additive 5 | 0.60 | 0.60 | 0.60 | 0.60 | 0.60 |
| TMP 1 | — | 0.25 | — | — | — |
| TMP 2 | — | — | — | 0.25 | — |
| Peroxide 2 | 1.9 | 1.9 | 1.9 | 1.9 | 1.9 |
| Plaque strip force (lbs/0.5") | bonded | 10 | 13 | 8 | 11 |

| Example | 6 | 7 | 8 | 9 | 10 |
|---|---|---|---|---|---|
| Insulation shield | | | | | |
| EVA 2 | 62.40 | 57.40 | 57.40 | 52.40 | 52.40 |
| NBR | — | 5.00 | 5.00 | 10.00 | 10.00 |
| Carbon black | 34.00 | 34.00 | 34.00 | 34.00 | 34.00 |
| Additive 1 | 0.80 | 0.80 | 0.80 | 0.80 | 0.80 |
| Additive 2 | 2.00 | 2.00 | 2.00 | 2.00 | 2.00 |
| Peroxide 1 | 0.80 | 0.80 | 0.80 | 0.80 | 0.80 |
| Insulation | | | | | |
| LDPE | — | 97.12 | — | 97.12 | — |
| Additive 4 | — | 0.38 | — | 0.38 | — |
| Additive 5 | — | 0.60 | — | 0.60 | — |
| Peroxide 2 | — | 1.9 | — | 1.9 | — |
| AT-320 | 100.00 | — | 100.00 | — | 100.00 |
| Plaque strip force (lbs/0.5") | 10 | 14 | 9 | 14 | 4 |

| Example | 11 | 12 | 13 |
|---|---|---|---|
| Insulation shield | | | |
| EVA 3 | 40.50 | 40.50 | 40.50 |
| NBR | 20.00 | 20.00 | 20.00 |
| Carbon Black | 36.00 | 36.00 | 36.00 |
| Additive 1 | 0.80 | 0.80 | 0.80 |
| Additive 2 | 2.00 | 2.00 | 2.00 |
| Peroxide 1 | 0.70 | 0.70 | 0.70 |
| Insulation | | | |
| LDPE | 97.12 | 96.97 | 96.87 |
| Additive 4 | 0.60 | 0.60 | 0.60 |
| Additive 5 | 0.38 | 0.38 | 0.38 |
| TMP 2 | 0.0 | 0.15 | 0.25 |
| Peroxide 2 | 1.9 | 1.9 | 1.9 |
| Plaque Strip Force (lbs/0.5") | Bonded | 11.6 | 11.3 |

Notes to Table I:

The EEA is a 20 g/10 min melt index ethylene-ethyl acrylate copolymer containing 35 percent by weight ethyl acrylate.

The EVA 1 is a 43 g/10 min melt index ethylene-vinyl acetate copolymer containing 28 percent by weight vinyl acetate.

The EVA 2 is a 30 g/10 min melt index ethylene-vinyl acetate copolymer containing 33 percent by weight vinyl acetate.

The EVA 3 is a 45 g/10 min melt index ethylene-vinyl acetate copolymer containing 20 percent by weight vinyl acetate.

NBR is an acrylonitrile butadiene copolymer containing 33 percent by weight acrylonitrile.

The carbon black is an N-550 type having a surface area of 43 square meters per gram (BET).

Additive 1 is 4,4'-bis(alpha, alpha-dimethylbenzyl) diphenyl amine.

Additive 2 is N,N'-ethylene bis stearamide.

Additive 3 is KE931U, a silicone rubber available from Shincor.

Peroxide 1 is dicumyl peroxide.

LDPE is a high pressure low density polyethylene having a density of 0.92 g/cc and a melt index of 2.1 g/10 min.

Additive 4 is 4,4'-thiobis(2-tert-butyl-5-methyl-phenol).

Additive 5 is a polyethylene glycol having an average molecular weight before processing of 20,000.

TMP 1 is N,N'-bis(2,2,6,6-tetramethyl-4-piperidinyl)-1,6-hexanediamine, polymer with 2,4,6-trichloro-1,3,5-triazine and 2,4,4-trimethyl-1,2-pentanamine, sold as Chimassorb™ 944 (CAS Registry Number 70624-18-9) by Ciba Specialty Chemicals.

TMP 2 is 1,6-hexanediamine, N,N'-bis(2,2,6,6-tetramethyl-4-piperidinyl)-polymer with 2,4,6-trichloro-1,3,5-triazine, reaction products with N-butyl-1-butanamine and N-butyl-2,2,6,6-tetramethyl-4-piperidinamine (CAS number 192268-64-7) available as Chimassorb™ 2020 from Ciba Specialty Chemicals.

Peroxide 2 is a blend containing 20 percent by weight dicumyl peroxide and 80 percent by weight ∝,∝'-bis(tert-butylperoxy)-diisopropylbenzene.

AT-320 is an insulation material described in claim 1 of U.S. Pat. No. 5,719,218, and is available from AT Plastics. It contains about 0.3 percent by weight of TMP 1.

EXAMPLES 14 TO 17

Thermogravimetric weight loss data is provided for copolymer samples run under nitrogen through a 10 degrees C. per minute temperature ramp up to a temperature of 400 degrees C. Relative to the ethylene/vinyl acetate copolymer with 33 percent vinyl acetate, thermal stability is improved (e.g. higher temperature for given weight loss) for the ethylene/ethyl acrylate sample with 25 percent ethyl acrylate. A reduction in vinyl acetate content also provides more thermally stability and permits higher vulcanization temperatures, and thus faster line speeds for an equivalent degree of cure, where current limitations are imposed to prevent generation of excessive amounts of acetic acid (a decomposition by-product of ethylene/vinyl acetate which is potentially damaging to process equipment). See Table II for variables and results.

TABLE II

| Example | 1 | 2 | 3 | 4 |
|---|---|---|---|---|
| Weight Loss (percent by weight) | 1% | 2% | 5% | 10% |
| Temperature in degrees C. for above specified weight loss (10 degrees C. per minute heating ramp in nitrogen) | | | | |
| EVA (33% VA) | 298 | 309 | 326 | 341 |
| EVA (20% VA) | 316 | 325 | 342 | 364 |
| EEA (25% EA) | 370 | 382 | greater than 400 | greater Than 400 |

Notes to Table:

EVA(33% VA) is a 30 g/10 min melt index ethylene-vinyl acetate copolymer containing 33 percent by weight vinyl acetate.

EVA(20% VA) is a 45 g/10 min melt index ethylene-vinyl acetate copolymer containing 20 percent by weight vinyl acetate.

EEA(25% EA) is a 20 g/10 min melt index ethylene-ethyl acrylate copolymer containing 25 percent by weight ethyl acrylate.

What is claimed is:

1. A cable comprising an electrical conductor or a core of electrical conductors surrounded by (A) an insulation layer, which is surrounded by, and contiguous with, (B) an insulation shield layer, the (A) insulation layer comprising:

(a) a polymer selected from the group consisting of polyethylene, ethylene/propylene copolymer rubber, ethylene/propylene/diene terpolymer rubber, and mixtures thereof, and, based on the weight of the insulation layer, (b) about 0.005 to about 1 percent by weight of a 4-substituted 2,2,6,6-tetramethylpiperidine containing one or more of the group

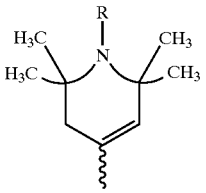

wherein R is hydrogen, or an alkoxy or an alkyl, each having 1 to 50 carbon atoms; and the (B) insulation shield layer comprising:

(a) a copolymer of ethylene an unsaturated ester selected from the group consisting of vinyl esters, acrylic acid esters, and methacrylic acid esters wherein the vinyl ester is present in the copolymer in an amount of about 10 to about 28 percent by weight based on the weight of the copolymer and the acrylic acid esters and methacrylic acid esters are present in an amount of about 10 to about 50 percent by weight based on the weight of component (B)(a);

(b) a conductive carbon black; and, based on the weight of the insulation shield layer, (c) at least about 5 percent by weight of a copolymer of acrylonitrile and butadiene wherein the acrylonitrile is present in the copolymer in an amount of about 25 to about 55 percent by weight based on the weight of component (B)(c).

2. The cable defined in claim 1 wherein components (A)(a) and (B)(a) are crosslinked.

3. The cable defined in claim 2 wherein component (B)(a) is either vinyl acetate or ethyl acrylate.

4. The cable defined in claim 3 wherein the vinyl acetate is present in the copolymer in an amount of about 15 to about 28 percent by weight.

5. The cable defined in claim 1 wherein component (A)(a) is a high pressure homopolymer of ethylene having a density in the range of 0.910 to 0.930 gram per cubic centimeter and a melt index in the range of about 1 to about 5 grams per 10 minutes.

6. The cable defined in claim 1 wherein component (A)(a) is an ethylene/propylene/diene terpolymer rubber.

7. The cable defined in claim 1 wherein component (A)(b) is present in an amount of about 0.1 to about 0.3 percent by weight.

8. The cable defined in claim 1 wherein, in component (A)(b), R is hydrogen, methoxy, or methyl.

9. The cable defined in claim 1 wherein component (B)(c) is present in an amount of about 10 to about 30 percent.

10. A cable comprising an electrical conductor or a core of electrical conductors surrounded by (A) an insulation layer, which is surrounded by, and contiguous with, (B) an insulation shield layer, the (A) insulation layer comprising:

(a) a polymer selected from the group consisting of a high pressure homopolymer of ethylene, ethylene/propylene/diene terpolymer rubber, and mixtures thereof, and, based on the weight of the insulation layer, (b) about 0.1 to about 0.3 percent by weight of a 4-substituted 2,2,6,6-tetramethylpiperidine derivative containing one or more of the group

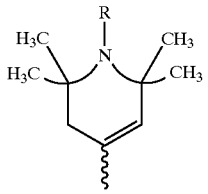

wherein R is hydrogen, methoxy, or methyl; and the (B) insulation shield layer comprising:

(a) a copolymer of ethylene and an unsaturated ester selected from the group consisting of vinyl acetate or ethyl acrylate wherein the vinyl acetate is present in the copolymer in an amount of about 15 to about 28 percent by weight and the ethyl acrylate is present in an amount of about 20 to about 40 percent by weight, both based on the weight of component (B)(a);

(b) a conductive carbon black; and, based on the weight of the insulation shield layer, (c) about 10 to about 30 percent by weight of a copolymer of acrylonitrile and butadiene wherein the acrylonitrile is present in the copolymer in an amount of about 25 to about 55 percent by weight based on the weight of component (B)(c).

11. The cable defined in claim 10 wherein component (A)(b) is (i) N,N'-bis(2,2,6,6-tetramethyl-4-piperidinyl)-1,6-hexanediamine, polymer with 2,4,6-trichloro-1,3,5-triazine and 2,4,4-trimethyl-1,2-pentanamine or (ii) 1,6-hexanediamine, N,N'-bis(2,2,6,6-tetramethyl-4-piperidinyl)-polymer with 2,4,6-trichloro-1,3,5-triazine, reaction products with N-butyl-1-butanamine and N-butyl-2,2,6,6-tetramethyl-4-piperidinamine.

* * * * *